United States Patent [19]

Wurm et al.

[11] 4,455,841

[45] Jun. 26, 1984

[54] HEAT-ACTUATED HEAT PUMPING APPARATUS AND PROCESS

[75] Inventors: Jaroslav Wurm, North Riverside; John A. Kinast, Chicago, both of Ill.

[73] Assignee: Institute of Gas Technology, Chicago, Ill.

[21] Appl. No.: 444,803

[22] Filed: Nov. 26, 1982

[51] Int. Cl.[3] ..... F25B 9/00

[52] U.S. Cl. ..... 62/6; 60/520

[58] Field of Search ..... 62/6; 60/517, 520

[56] References Cited

U.S. PATENT DOCUMENTS

| | | | |
|---|---|---|---|
| 3,858,802 | 1/1975 | Stobart | 60/517 |
| 3,994,136 | 11/1976 | Polster | 60/518 |
| 4,044,558 | 8/1977 | Benson | 60/520 |

*Primary Examiner*—Ronald C. Capossela

*Attorney, Agent, or Firm*—Thomas W. Speckman

[57] ABSTRACT

A heat actuated heat pumping apparatus and process having two working chambers to provide a Vuilleumier cycle for space conditioning. The working chamber volumes are in pressure communication with each other in the vicinity of intermediate thermal exchange means in each volume equalizing the pressure between the two working volumes with one module acting as the driver for the heat pumping action of the second module. Pressure communication may be maintained through a floating piston thereby providing two different intermediate heat rejection temperature levels resulting in a four temperature level Vuilleumier heat pump. The apparatus and process of this invention reduces mechanical complexity and improved thermal exchange in a heat pump system suitable for large air conditioning applications and hot water heating as well as small refrigeration and cryogenic applications.

21 Claims, 8 Drawing Figures

HEAT-ACTUATED HEAT PUMPING APPARATUS AND PROCESS

BACKGROUND OF THE INVENTION

1. Field of the Invention

This invention relates to heat-actuated heat pumping apparatus and process having two working chambers to provide a Vuilleumier cycle for space conditioning, including space cooling and heating, refrigeration, hot water heating, and cryogenic applications. Gaseous working fluid is displaced through sets of heat exchangers in a phased relationship by means of externally or internally driven displacers between two working chamber volumes. The working chamber volumes are in pressure communication with each other in the vicinity of intermediate thermal exchange means in each volume equalizing the pressure between the two working volumes with one module acting as the driver for the heat pumping action (refrigeration) of the second module. The pressure communication between the two working volumes may be through a floating piston thereby providing two different intermediate heat levels, resulting in a four temperature level Vuilleumier heat pump. The apparatus and process of this invention reduces mechanical complexity and improves thermal exchange in a heat pump apparatus suitable for large air conditioning applications as well as small refrigeration and cryogenic applications.

2. Description of the Prior Art

Stirling cycle engines are well known for compressing or expanding a gas working fluid for power or refrigeration uses. Stirling cycle engines are generally classified as opposed piston engines or displacer piston engines which, in order to obtain double-acting Stirling engines, have required multiple pistons and have been bulky with large dead volumes. U.S. Pat. No. 3,460,344 teaches a double-acting Stirling engine employing a single cylinder by use of vanes to coordinate the working fluid motion thereby eliminating reciprocating motion between the crankcase and working chambers and reducing the problem of sealing the working fluid from the crankcase.

U.S. Pat. No. 4,253,859 relates to a Kirk cycle gas refrigerator utilizing rod members to effect volumetric changes of a refrigerating medium to produce low temperatures. A floating piston is used between a driving cylinder and an expansion cylinder.

U.S. Pat. No. 3,474,641 teaches a heat-actuated regenerative compressor for operation between fixed pressures providing movement of gas by an oscillatory displacer through a cooler, regenerator and heater which may be used as a prime mover or through a pressure sensitive means may be used to pump a refrigerant through a condensation-expansion-evaporation-compression cooling cycle. U.S. Pat. No. 3,521,461 teaches operation of a heat-actuated regenerative compressor of the U.S. Pat. No. 3,474,641 in conjunction with a pneumatic assisted linkage with a refrigerant in a compression-condensation-expansion-evaporation cooling cycle that permits operation of the power and refrigeration cycles at different average pressures, allowing the power cycle to be at higher pressure than the refrigeration cycle, thereby increasing specific output. U.S. Pat. No. 3,716,988 teaches a heat-actuated regenerative compressor in combination with an expansion device which extracts work, such as a piston or rotary expander which is isolated from the active volume of the compressor and is at different pressures and temperatures than the compressor at the time of extraction of energy. The apparatus is advantageously used as a prime mover and in conjunction with pumping systems. U.S. Pat. No. 3,690,113 teaches a cyclic gas cooling apparatus and process wherein a thermal compressor and thermal regenerative means is in communication with a pressure regenerative means for use in air conditioning systems.

Vuilleumier cycles and variations thereof are known; U.S. Pat. No. 1,275,507 teaching an elementary Vuilleumier cycle and apparatus; U.S. Pat. No. 3,151,466 teaching Vuilleumier cryogenic cycles, all ideally maintaining time-varying, spacially-uniform pressure throughout the fluid system. The apparatus of both the U.S. Pat. Nos. 1,275,507 and 3,151,466 operates with reciprocating cylindrical displacers. U.S. Pat. No. 3,630,041 teaches an improvement of the Vuilleumier cycle refrigerator providing that the hot and cold cylinders are physically separated with an independent drive means for each displacer. Another modification of the Vuilleumier refrigerator is taught by U.S. Pat. No. 3,862,546 providing very rapid and high thermal heat-up by using electric resistance heating elements which change their resistance in the desired temperature range. Another modification of the Vuilleumier refrigerator cycle is taught by U.S. Pat. No. 4,024,727 which has a separate pneumatically operated cold displacer to produce cryogenic refrigeration.

SUMMARY OF THE INVENTION

The heat-actuated heat pumping apparatus and process of this invention provides a two-module Vuilleumier system wherein one module functions as the pressure driver for the heat pumping action of the other module. The two-module units of the present invention provide mechanical simplicity and improved heat transfer. The oscillating displacers or vanes of the two modules operate at a predetermined phase relationship and are linked or driven mechanically or pneumatically, providing mechanically simple devices as compared with reciprocating piston-type devices of the prior art. The apparatus and process of the present invention results in a physical arrangement of heat transfer elements providing reduced pressure drops for the working fluid flowing therethrough and providing a physically compact overall size with a small amount of dead volume. The physical configuration of the apparatus of this invention also allows better insulating of the working volumes to reduce heat loss to the ambient surroundings. Further, the oscillating vane displacer elements in the apparatus of this invention can be operated nonsinusoidally to enhance the heat pumping effect.

The apparatus and process of this invention provides a high efficiency Vuilleumier heat pump for use in heat pumping. By heat pumping as used throughout this disclosure and in the appended claims, we mean to include residential and commercial or industrial air conditioning, including both heating and cooling, hot water heating, refrigeration and cryogenic applications.

A heat-actuated pumping apparatus according to this invention has a first casing defining a first cylindrical chamber for confining gas and located within that casing is a low temperature thermal exchange means, a thermal regenerative means having one side adjacent the low temperature thermal exchange means and a first intermediate temperature thermal exchange means adjacent the other side of the thermal regenerative means. The adjacently related low temperature thermal exchange means, regenerative means, and intermediate temperature thermal exchange means may be pie-shaped or may be substantially rectangular in cross section to extend from the outer casing toward the center of the chamber, as will be described in more detail below, so that an oscillating vane displaces gas through the thermal exchange and regenerative means in both directions. An oscillating vane divides the remaining portion of the volume of the first chamber into a first intermediate temperature volume and a lower temperature volume and by its oscillatory movement displaces the gas from the first intermediate temperature volume to the lower temperature volume by passage sequentially through the intermediate temperature thermal exchange means, thermal regenerative means and low temperature thermal exchange means to the lower temperature volume at a lower average temperature-pressure, and by its reverse oscillatory movement displaces the gas from the lower temperature volume in a reverse direction to the first intermediate temperature volume at a higher intermediate average temperature-pressure. A second casing defines a second cylindrical chamber having located in that chamber a high temperature thermal exchange means, a thermal regenerative means having one side adjacent the high temperature thermal exchange means and a second intermediate temperature thermal exchange means adjacent the other side of the thermal regenerative means. The adjacently related thermal exchange and regenerative means may be physically arranged as described above. An oscillating vane divides the remaining portion of the volume of the second chamber into a second intermediate temperature volume and a higher temperature volume and by its oscillatory movement, displaces the gas from the second intermediate temperature volume sequentially through the second intermediate temperature thermal exchange means, thermal regenerative means and high temperature thermal exchange means to the higher temperature volume at a higher average temperature-pressure, and by its reverse oscillatory movement displaces the gas from the higher temperature volume in a reverse direction to the second intermediate temperature volume at lower intermediate average gas temperature-pressure. The first intermediate temperature volume located in the first chamber and the second intermediate temperature volume located in the second chamber are in pressure communication in the vicinity of the intermediate temperature thermal exchange means. The pressure communication between the two intermediate temperature volumes in the vincinity of the intermediate temperature thermal exchange means provides the same pressure in each of the modules at these locations. It is readily apparent that the pressure communication is advantageously located at the edge of the intermediate temperature thermal exchange means to utilize foil oscillatory movement of the vane. In one embodiment, the pressure communication means is an open conduit allowing free passage of the contained gas between the two modules and in this embodiment the temperature in the two intermediate temperature volumes is substantially the same. The pressure communication means provides that the multiple modules of this invention operate at substantially the same time-varying, spatially-uniform pressure and at a constant volume.

In one embodiment of this invention, the pressure communication between two modules is provided by a floating piston in the conduit between the modules to prevent the transfer of gas between the two modules but to provide the same pressure in each of the modules. This embodiment provides a Vuilleumier cycle which may be operated at four district temperature levels providing rejection of heat at two different intermediate temperature levels. Operation of the Vuilleumier cycle at four different temperature levels makes a more flexible apparatus and process. Heat rejection at two temperature levels aids in the reduction of the power generating module rejection temperature which in turn increases the overall COP. In practice, rejection of heat at two levels allows the cooling medium to be used more efficiently by being first passed through the lower temperature heat rejection exchanger and then through the higher temperature heat rejection exchanger. The two temperature heat rejection is also advantageous whenever two different temperatures are desired for use, such as in a combined water heater/furnace.

In aother embodiment, the two modules may be physically separated at greater distances by use of two floating pistons in a pressure communication conduit between the two modules, the two working pistons having a substantially incompressible fluid between them. This reduces the dead spaces from that which would otherwise be present.

It is an object of this invention to provide a high efficiency heat pump utilizing the Vuillemier cycle for space conditioning.

It is another object of this invention to provide a heat-actuated space conditioning apparatus and process for high efficiency heating and cooling.

It is still another object of this invention to provide a four-temperature level Vuilleumier cycle heat pump.

It is yet another object of this invention to provide a heat actuated space conditioning apparatus having reduced dead volume, more effective insulation of the working volumes from the ambient surroundings, and oscillating displacer elements which can be operated non-sinusoidally.

BRIEF DESCRIPTION OF THE DRAWING

The above and other objects and advantages of this invention will become apparent from the following description taken in conjunction with the accompanying drawings showing preferred embodiments wherein.

DESCRIPTION OF THE PREFERRED EMBODIMENTS

Figure 1A:
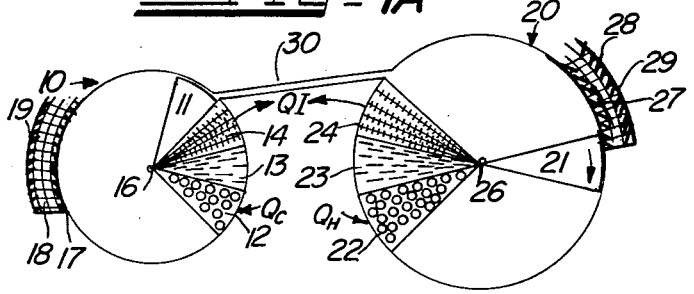
FIG. 1A, FIG. 1B, FIG. 1C, and FIG. 1D show one embodiment of a heat actuated heat pumping apparatus of this invention schematically showing the oscillating vanes in different positions of the cycle.

FIG. 1A shows one embodiment of a heatactuated heat pumping apparatus according to this invention having heat pumping (refrigeration) module 10 with outer shell casing 19, insulation 18, and inner shell casing 17 defining a cylindrical chamber capable of confining gas. Within inner shell casing 17 is low temperature thermal exchange means 12 and first intermediate temperature thermal exchange means 14 with thermal regenerative means 13 between and adjacent to the two thermal exchange means. As shown in FIG. 1A, the thermal exchange means and regenerative means are essentially triangular filling an arcuate portion of the cylindrical chamber from inner shell casing 17 to the center of its radius. However, the thermal exchange and regenerative means are designed in such a way that either spatially uniform gas flow distribution is achieved or the heat transfer rate is increased, while in both cases keeping the dead spaces low. Heat pumping module oscillating vane displacer 11 divides the chamber of the cooling module into a first intermediate temperature volume adjacent the first intermediate temperature thermal exchange means and a lower temperature volume adjacent the low temperature thermal exchange means. Power generating module 20 is similarly a cylindrical chamber formed by inner shell casing 27 with insulation 28 and outer shell casing 29. Mounted within the power generation chamber volume is second intermediate thermal exchange means 24, thermal regenerative means 23 and high temperature thermal exchange means 22 in adjacent relation. The power generation module chamber has oscillating displacer 21 dividing the chamber into a second intermediate temperature volume adjacent the second intermediate temperature thermal exchange means and a higher temperature volume adjacent the high temperature thermal exchange means. For highest efficiency the thermal exchange means and the thermal regenerative means extend for the full length of the respective chambers as do displacers 11 and 21. An important feature of this invention is the combination of the heat pumping module 10 and the power generation module 20 with pressure communication conduit 30 joining the intermediate temperature volumes of each of the chambers at a location just before or just after the confined gas enters or leaves the intermediate temperature thermal exchange means. Pressure communication conduit 30 desirably opens into each of the chambers near the intermediate temperature thermal exchange means and to provide most efficient operation, is positioned so that it only communicates with the intermediate temperature volume at all times and is not sealed or partially sealed by the displacers. It is preferred that the opening of each end of the pressure communication conduit 30 be adjacent to the two intermediate temperature thermal exchange means, as shown in FIG. 1A.

FIGS. 1A through 1D schematically illustrate the steady-state operation of the heat pump cycle of the embodiment of apparatus as shown in FIGS. 1A through 1D. FIGS. 1A through 1D schematically show the heat exchangers, regenerators and displacers as triangular, but they may be any physical shape and size to achieve the described function and exhibit insulating properties, respectively. In the position shown in FIG. 1A, the displacer 11 of heat pumping module 10 is at its maximum position adjacent intermediate temperature thermal exchange means 14 and displacer 21 of power generation module 20 is at its mid-point moving toward high temperature thermal exchange means 22. The mean gas temperature is relatively low and consequently the gas pressure is low. When the displacers move to the position shown in FIG. 1B, both the hot and the cold volumes decrease. Part of the relatively cold gas in heat pumping module 10 is forced through thermal regenerative means 13 where it is heated to nearly the temperature of intermediate temperature thermal exchange means 14. Most of the relatively hot gas in power generating module 20 has been forced through thermal regenerative means 23 where it is cooled to nearly the temperature of intermediate temperature thermal exchange means 24. In the embodiment shown in FIG. 1, the intermediate temperature thermal exchange means 14 and 24 are both at approximately the same temperature due to open conduit 30 and both reject heat at this temperature, the total heat rejected denoted as $Q_I$. As the displacers turn to the position shown in FIG. 1C, the hot volume of power generation module 20 adjacent high temperature thermal exchange means 22 increases while the cold volume of heat pumping module 10 adjacent low temperature thermal exchange means 12 decreases. The net effect is an increase in the mean gas temperature and gas pressure. During this compression, heat is rejected from the intermediate temperature thermal exchange means. As the displacers continue their movement to the position shown in FIG. 1D, both the hot volume of power generating module 20 adjacent high temperature thermal exchange means 22 and the cold volume of module 10 adjacent low temperature thermal exchange means 12 increase. In the heat pumping module, part of the warm gas is forced through cold thermal regenerator 13 where it is cooled to nearly the temperature of low temperature thermal exchange means 12. In power generating module 20, part of the warm gas is forced through hot thermal regenerator 23 where it is heated to nearly the temperature of high temperature thermal exchange means 22. To complete the cycle, the displacers move from the position shown in FIG. 1D to the position shown in FIG. 1A with a decrease in the hot volume of power generating module adjacent high temperature thermal exchange means 22 and an increase in the cold volume of heat pumping module 10 adjacent low temperature thermal exchange means 12. The net effect is a decrease in the mean gas temperature and pressure during which heat is absorbed by both the high temperature thermal exchange means 22 and the low temperature thermal exchange means 12. Thus, it is seen that a three temperature Vuilleumier cycle is achieved with $Q_c$ amount of heat absorbed at low temperature thermal exchange means 12, $Q_I$ heat rejected at intermediate temperature thermal exchange means 14 and 24 and $Q_H$ heat absorbed at high temperature thermal exchange means 22.

Figure 2:
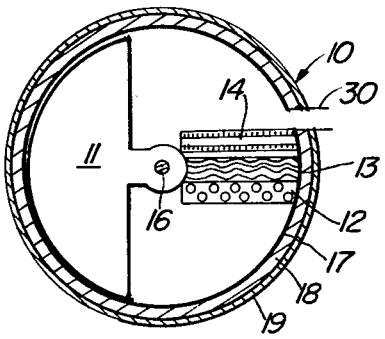
FIG. 2 shows another embodiment of this invention providing rectangular thermal exchangers.
Figure 1B:
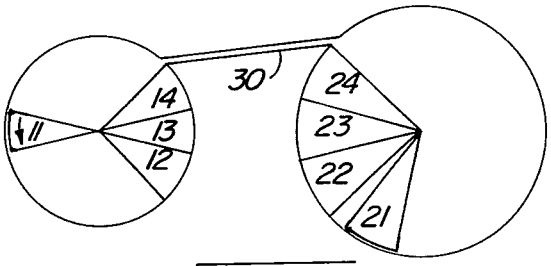

FIG. 2 shows another embodiment of a heat-actuated heat pumping apparatus having rectangular cross-sectional shaped thermal exchangers and regenerator providing simplified gas flow therethrough. The apparatus shown in part in FIG. 2 may be operated in the same fashion as described above.

Figure 4:
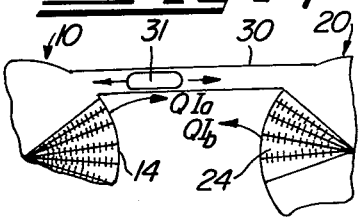
FIG. 4 schematically shows another embodiment of this invention having a floating piston providing pressure communication between the volumes of two chambers and four-temperature operation.
Figure 1C:
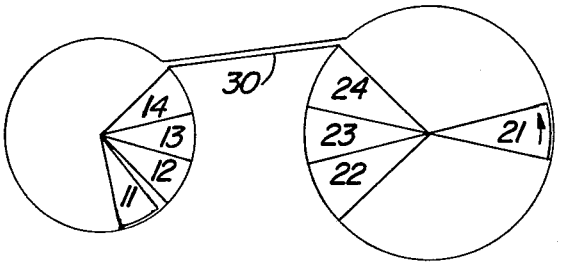

FIG. 4 shows another embodiment of this invention wherein pressure communication conduit 30 houses adiabatic free floating piston 31 which separates the intermediate temperature volume of heat pumping module 10 from the intermediate temperature volume of power generating module 20 in the region of the intermediate temperature thermal exchangers. The free floating piston acts to transmit the pressure variations between the two modules while thermally isolating the two intermediate temperature working volumes of the chambers. The floating piston allows the two modules to operate at uniform pressure but limits mixing of the working fluid and heat transfer between the two chambers thus forming a four temperature level Vuilleumier cycle heat pump. The apparatus and process, as illustrated schematically in FIG. 4, provides different intermediate temperature operating conditions in each of the modules which reject heat denoted as $Q_{Ia}$ at intermediate temperature thermal exchange means 14 and $Q_{Ib}$ at intermediate temperature thermal exchange means 24. This configuration retains the instantaneous, spatially-uniform pressure levels of the typical Vuilleumier cycle while permitting true operation at four different temperature levels transferring heat $Q_c$, $Q_{Ia}$, $Q_{Ib}$, and $Q_H$, at these levels, respectively. The apparatus and process of this invention, operating at four different temperature levels, may be used in similar fashion to Stirling-Stirling heat pumps which also operate at four temperature levels. Increased COP results from the lowering of the rejection temperature and the cooling medium may be utilized more efficiently by passing in series through the lower and then the higher heat rejection exchanger. Many applications, such as combined water heater/furnace may directly utilize the heat rejected at two temperatures.

Figure 5:
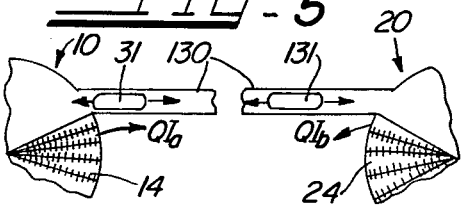
FIG. 5 schematically shows another embodiment of this invention utilizing two floating pistons with an incompressible fluid between them for pressure communication between two chambers.
Figure 1D:
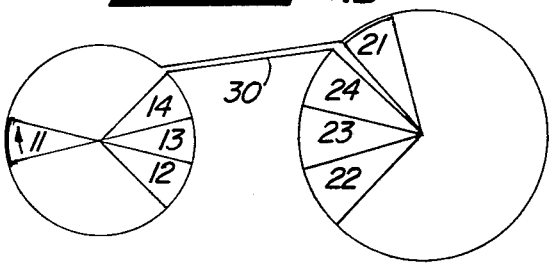

FIG. 5 schematically shows another variation of the prior described embodiment of this invention having two floating pistons 31 and 131 separated by relatively long pressure communication conduit 130 between them and filled with a non-compressible fluid for pressure transmission. Any suitable non-compressible fluid, such as hydraulic oil, may be used as will be readily apparent to one skilled in the art upon reading this disclosure. Using this embodiment, the two modules may be located at greater distances from each other as desired. This embodiment also results in the four temperature Vuilleumier cycle having two intermediate temperatures rejecting heat of $Q_{Ia}$ and $Q_{Ib}$ amount, as previously described with respect to FIG. 3. Separation of the modules in the manner shown in FIG. 4 is achieved without addition of dead volume which maintains the high efficiency of the system.

Figure 3:
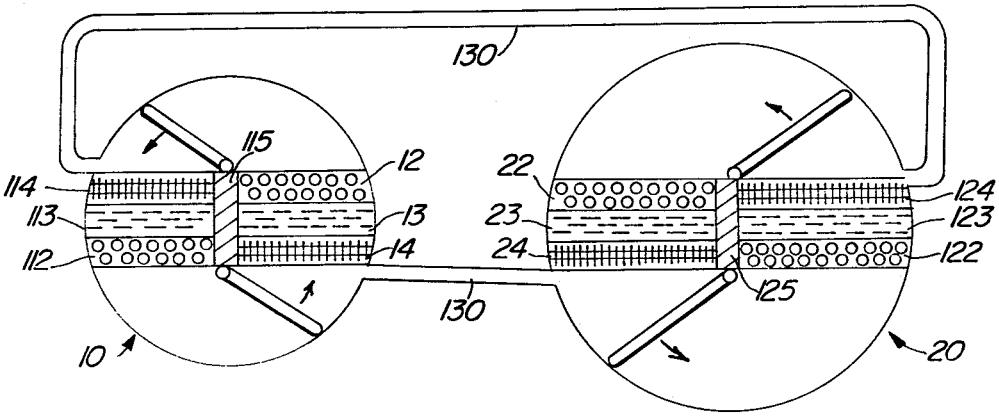
FIG. 3 schematically shows another embodiment of this invention with placement of two vanes and two sets of thermal exchangers and thermal regenerator within a single chamber.

The embodiment shown in FIG. 3 utilizes a physical configuration which allows substantially rectangular thermal exchangers and thermal regenerators with two cooling cycles within heat pumping module 10 and two heating cycles within power generating module 20. As shown in FIG. 3, low temperature thermal exchange means 12, thermal regenerative means 13 and intermediate temperature thermal exchange means 14 are situated adjacent each other and are separated by thermal insulator 115 from corresponding but reversibly arranged low temperature thermal exchange means 112, thermal regeneration means 113 and intermediate temperature thermal exchange means 114 which operate at the same respective temperatures as the corresponding thermal exchangers and regenerative means within the same heat pumping module. The gas passes through one set of thermal exchangers in one direction and the other set of thermal exchangers in the reverse direction. In a similar manner, two opposed units are arranged within power generating module 20. The two vanes within each module operate at 180° rotational synchronization. Conduit 30 joins the intermediate temperature volumes of the lower portion of the heat pumping and power generating modules while pressure communication conduit 130 joins the intermediate temperature volumes of the upper chambers in the manner shown. These pressure communication conduits may also be operated with one or two free pistons as described above to provide four temperature Vuilleumier cycle operation.

The thermal exchangers used in this invention may be constructed of materials having suitable thermal properties such as copper, stainless steel, Hastalloy, or ceramics. Each of the thermal exchangers is designed to have maximal frontal area consistent with suitable thermal exchange properties to minimize the pressure drop of gas by movement through the thermal exchangers. It is also desired to have minimal dead gas volume within the thermal exchangers.

Low temperature thermal exchange means 12 and 112 may be constructed of a suitable metal for containment of the cooling media and meeting the above requirements. Flat duct-type coolers with narrow spacing or finned cooler configurations with close spaced fins or heat transfer elements equipped to maintain isothermal conditions may be used to effect high heat transfer with low dead volume. Cooling fluid from an external source is circulated through cooling means 12 for absorbing of heat by the system for heat pumping. Any cooling fluid which transports heat may be used. For heat pumping or refrigeration applications water or brine from heat exchangers in the ground or in ice or contacting ambient air may be used, or ambient air may be used directly as the cooling fluid. For cryogenic applications the cooling fluid may be any suitable fluid for the desired temperature range. In LNG production, the natural gas stream itself may be used. For other applications substances which are gaseous at room temperature may be used, such as liquid nitrogen, helium or hydrogen.

High temperature thermal exchange means 22 and 122 is preferably a tube bundle heater and may be supplied with heat obtained by external combustion of natural fuels, such as gas, or may be electrically heated, or may utilize a heat transfer fluid or heat pipes for transfer for high temperature heat input such as known heat pipes utilizing lithium, sodium and potassium. Heat transfer within the high temperature thermal exchange means may be enhanced by employing extended surfaces using isothermalizing elements and use of radiation shields of wire cloth which additionally avoids radiation from unduly heating adjacent volumes.

The intermediate temperature thermal exchange means may be constructed in a similar fashion to either the high temperature thermal exchange means or the low temperature thermal exchange means and consistent with the above desirable design parameters set forth, dependent upon the temperatures of operation of the particular unit.

The thermal regenerative means 13 and 23 are positioned between the low temperature thermal exchange means and the intermediate temperature thermal exchange means and between the high temperature thermal exchange means and an intermediate temperature thermal exchange means for thermal storage and thermal exchange. The regenerative means are preferably flat or corrugated stainless steel wire cloth or fine wire mesh arranged in successive layers with no or minimal thermal contact between the layers to provide a thermal gradient in the regenerator between a higher temperature side and a lower temperature side. Any other material suitable for such means, such as metallic felts, may also be utilized.

Suitable materials for construction of inner shell casing 17, insulation 18 and outer shell casing 19 will be readily apparent to those skilled in the art upon reading this disclosure. One advantage of the apparatus of this invention is the greater effectiveness and ease of insulation of the two modules due to only a portion of the temperature differential being in each of the modules since the low temperature thermal exchange means is in one module and the high temperature thermal exchange means is in the second module. The reduced temperature differential within the module also makes the thermal isolation of a first volume from a second volume by displacer 11 or 21 more effective. The displacer, insulation and inner casing may be constructed from a thermal insulating material such as ceramics, fused silica glass, and other materials known in the art.

Displacer 11 is secured in fixed relationship to shaft 16 which is disposed through heat pumping module 10 in rotatable relation by suitable bearing means, shaft 16 penetrating inner shell casing 17, insulation 18 and outer shell casing 19 in fluid tight relationship and is connected through suitable linkage means to a power source which causes shaft 14 to undergo the desired oscillating movement. Displacer 21 is similarly attached to shaft 26. The displacers are shown as having a semi-arcuate configuration which has its curved outer surface in sealing relationship with inner shell casing 17. The displacer shafts are externally linked by mechanical, pneumatic or electronic coordination means so that displacer 11 and displacer 21 may operate in desired out-of-phase operation, shown in FIGS. 1A through 1D as 90° out-of-phase at the mid-point of the chamber, the displacer in driving module 20 being about 25 percent of a cycle ahead of the displacer in heat pumping module 10. It is preferred that the driving cycle be operated out-of-phase with and about 15 to about 35 percent of a cycle ahead of the heat pumping cycle. Non-sinusoidal motion of the displacers allows closer approximation of the theoretical cycle by reducing damping effects on the pressure and temperature extremes. The theoretical energy required for displacer oscillation can be as low as a fraction of one percent of the total energy input to the apparatus of this invention, the major energy input being heat.

The heat-actuated heat pumping apparatus of this invention may be operated by use of various working gases having desired physical characteristics such as inert gases including hydrogen, helium, neon, argon, krypton and xenon being preferred gases. A single gas or mixtures of different gases may be used. Any gas or mixture of gases suitable for Stirling or other Vuilleumier devices may be used.

Displacer frequencies are limited by practical considerations of rapidity of direction change of the displacer. Generally, frequencies of about 15 to 100 cycles per minute and higher are suitable. The lower frequencies reduce the pressure drop for a given heat exchange surface area, while the higher frequencies allow higher specific output.

Although the cooling module and heating module have been shown in the figures to be somewhat different in size, it is readily apparent that modules with varying ratios of size may be used to achieve desired thermal characteristics of the apparatus. The power producing module will generally be larger than the heat pumping module, the ratio of sizes depending upon design temperatures.

The heat actuated process for heat pumping according to this invention uses gaseous working fluid in two working volumes, one working volume functioning as the pressure driver for the heat pumping action of the second working volume. In the pressure driving cycle gaseous working fluid is passed from a high temperature confined volume in sequence through a high temperature thermal exchange means, a thermal regenerative means, and a first intermediate temperature thermal exchange means to a first intermediate temperature confined volume within the driving working volume. Heat is added to the high temperature thermal exchange means. The gaseous working fluid in the pressure driving working volume is then passed in reverse from the first intermediate temperature confined volume in sequence through the intermediate temperature thermal exchange means, the thermal regenerative means, and the high temperature thermal exchange means to the high temperature confined volume. Heat is removed from the first intermediate temperature thermal exchange means. In the heat pumping cycle, gaseous working fluid is passed from a second intermediate temperature confined volume in sequence through a second intermediate temperature thermal exchange means, a thermal regenerative means, and a low temperature thermal exchange means to a low temperature confined volume. Heat is added to the low temperature thermal exchange means. The gaseous working fluid is then passed in reverse from the low temperature confined volume in sequence through the low temperature thermal exchange means, the thermal regenerative means, and the second intermediate temperature thermal exchange means to the second intermediate temperature confined volume. Heat is removed from the second intermediate temperature thermal exchange means. Substantially the same pressure is maintained between the first and second intermediate temperature volumes by pressure communication between them. It is preferred to operate the driving cycle out-of-phase with and about 15 to about 35 percent of a cycle ahead of the heat pumping cycle.

One important aspect of the process of this invention is an improved Vuilleumier cycle process wherein pressure communication is maintained between a first intermediate temperature volume in a pressure driver module for driving a heat pumping module and a second intermediate temperature volume in that heat pumping module. When the pressure communication between the two separated intermediate temperature volumes is an open conduit, the temperature of both intermediate temperature volumes is substantially the same. However, according to one embodiment of this invention the pressure communication between the first intermediate temperature volume and the second intermediate temperature volume may be through a substantially gas tight floating piston within the conduit joining the two intermediate temperature volumes. In this case, a different temperature may be maintained between the first intermediate temperature volume and the second intermediate temperature volume while maintaining substantially the same pressure, thereby providing a four temperature Vuilleumier cycle.

Operation of the system of this invention as a space heater may utilize a low temperature of about 0° C., intermediate temperature of about 50° C., and high temperature of about 500° C. for a mild winter day with the low temperature dropping to about −10° C. to −20° C. for more severe conditions without seriously decreasing the heating coefficient of performance. When used for cooling, the low temperature may be about 10° to 20° C. and the intermediate temperature may rise to about 55° C. The high temperature depends primarily upon the firing rate of the burner and is generally independent of external conditions.

The system of this invention may be used in natural gas fields for liquefying (cooling) natural gas for transport and storage.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A heat-actuated space conditioning apparatus comprising two modules, a first module functioning as the pressure driver for heat pumping action of the second module, said apparatus comprising:

a first pressure driving module comprising a first casing defining a first cylindrical chamber for confining gas, a high temperature thermal exchange means, a thermal regenerative means having one side adjacent said high temperature thermal exchange means, a first intermediate temperature thermal exchange means adjacent the other side of said thermal regenerative means, each said high temperature thermal exchange means, said thermal regenerative means, and said first intermediate temperature thermal exchange means adjacently extending for substantially the length of said first chamber and from said casing toward the center of said first chamber, an oscilliating displacer dividing said first chamber into a first intermediate temperature volume and a higher temperature volume and by oscillatory movement displacing said gas from said intermediate temperature volume sequentially through said first intermediate temperature thermal exhange means, thermal regenerative means and high temperature thermal exchange means to said higher temperature volume at a higher average temperature-pressure, and displacing said gas in a reverse direction from said higher temperature volume to said first intermediate temperature volume at a lower intermediate average temperature-pressure;

a second heat pumping module comprising a second casing defining a second cylindrical chamber for confining gas, a low temperature thermal exchange means, a thermal regenerative means having one side adjacent said low temperature thermal exchange means, a second intermediate temperature thermal exchange means adjacent the other side of said thermal regenerative means, each said low temperature thermal exchange means, said thermal regenerative means, and said second intermediate temperature thermal exchange means adjacently extending for substantially the length of said second chamber and from said casing toward the center of said second chamber, an oscillating displacer dividing said second chamber into a second intermediate temperature volume and lower temperature volume and by oscillatory movement displacing said gas from said second intermediate temperature volume sequentially through said intermediate temperature thermal exchange means, thermal regenerative means and low temperature thermal exchange means to said lower temperature volume at a lower average temperature-pressure, and displacing said gas in a reverse direction from said lower temperature volume to said second intermediate temperature volume at a higher intermediate average gas temperature-pressure; and pressure communication means between said first intermediate temperature volume of said first chamber in the vicinity of said first intermediate temperature thermal exchange means and said second intermediate temperature volume of said second chamber in the vicinity of said intermediate temperature thermal exchange means.

2. The apparatus of claim 1 wherein said pressure communication means comprises an open conduit.

3. The apparatus of claim 2 wherein said open conduit opens at each end adjacent said intermediate temperature thermal exchange means.

4. The apparatus of claim 1 wherein said pressure communication means comprises a conduit having a substantially gas tight floating piston movably mounted therein.

5. The apparatus of claim 4 wherein said conduit opens at each end adjacent said intermediate temperature thermal exchange means.

6. The apparatus of claim 1 wherein said pressure communication means comprises a conduit having a first substantially gas tight floating piston movably mounted therein at one end region and a second substantially gas tight floating piston movably mounted therein at the opposite end region.

7. The apparatus of claim 6 wherein said conduit opens at each end adjacent said intermediate temperature thermal exchange means.

8. The apparatus of claim 6 wherein a substantially incompressible fluid is maintained in said conduit between said first and second floating pistons.

9. The apparatus of claim 1 wherein each of said modules comprise two operating volumes and sets of thermal exchange means and thermal regenerative means, said apparatus comprising:

a first pressure driving module comprising a first casing defining a first cylindrical chamber for confining gas, two high temperature thermal exchange means, two thermal regenerative means each having one side adjacent each said high temperature thermal exchange means, two first intermediate temperature thermal exchange means each adjacent the other side of each said thermal regenerative means, one of said high temperature thermal exchange means, one of said thermal regenerative means, and one of said first intermediate temperature thermal exchange means adjacently extending for substantially the length of said first chamber and from said casing toward the center of said first chamber and separated by a thermal insulator from the second corresponding reversible arranged said high temperature thermal exchange means, thermal regenerative means and intermediate temperature thermal exchange means; two oscillating displacers extending from said thermal insulator dividing said first chamber into two sets of chambers each comprising a first intermediate temperature volume and a higher temperature volume and by oscillatory movement displacing said gas from each said intermediate temperature volume sequentially through each said first intermediate temperature thermal exchange means, thermal regenerative means and high temperature thermal exchange means to each said higher temperature volume at a higher average temperature-pressure, and displacing said gas in a reverse direction from each said higher temperature volume to each said first intermediate temperature volume at a lower intermediate average temperature-pressure;

a second heat pumping module comprising a second casing defining a second cylindrical chamber for confining gas, two low temperature thermal exchange means, two thermal regenerative means each having one side adjacent each said low temperature thermal exchange means, two second intermediate temperature thermal exchange means each adjacent the other side of each said thermal regenerative means, one of said low temperature thermal exchange means, one of said thermal regenerative means, and one of said second intermediate temperature thermal exchange means adjacently extending for substantially the length of said second chamber and from said casing toward the center of said second chamber and separated by a thermal insulator from the second corresponding reversible arranged low temperature thermal exchange means, thermal regenerative means and intermediate temperature thermal exchange means; two oscillating displacers extending from said thermal insulator dividing said second chamber into two sets of chambers each comprising a second intermediate temperature volume and a lower temperature volume and by oscillatory movement displacing said gas from each said second intermediate temperature volume sequentially through each said intermediate temperature thermal exchange means, thermal regenerative means and low temperature thermal exchange means to each said lower temperature volume at a lower average temperature-pressure, and displacing said gas in a reverse direction from each said lower temperature volume to each said second intermediate temperature volume at a higher intermediate average gas temperature-pressure; and a first pressure communication means between one of said first intermediate temperature volumes of said first chamber in the vicinity of said first intermediate temperature thermal exchange means and one of said second intermediate temperature volumes of said second chamber in the vicinity of said intermediate temperature thermal exchange means and a second pressure communication means between the other of said first intermediate temperature volumes of said first chamber in the vicinity of said first intermediate temperature thermal exchange means and the other of said second intermediate temperature volumes of said second chamber in the vicinity of said intermediate temperature thermal exchange means.

10. The apparatus of claim 9 wherein at least one of said pressure communication means comprises a conduit having a first substantially gas tight floating piston movably mounted therein at one end region and a second substantially gas tight floating piston movably mounted therein at the opposite end region.

11. The apparatus of claim 10 wherein a substantially incompressible fluid is maintained in said conduit between said first and second floating pistons.

12. The apparatus of claim 9 wherein said displacers in each said module are at about 180° rotational synchronization.

13. In a heat-actuated process for heat pumping using gaseous working fluid in two working volumes, one working volume functioning as the pressure driver for the heat pumping action of the second working volume, the steps comprising:

passing gaseous working fluid in a pressure driving cycle in said driving working volume from a high temperature confined volume in sequence through a high temperature thermal exchange means, a thermal regenerative means, and a first intermediate temperature thermal exchange means to a first intermediate temperature confined volume, and adding heat to said high temperature thermal exchange means; then passing said gaseous working fluid in said pressure driving working volume in reverse from said first intermediate temperature confined volume in sequence through said first intermediate temperature thermal exchange means, said thermal regenerative means, and said high temperature thermal exchange means to said high temperature confined volume, and removing heat from said first intermediate temperature thermal exchange means;

passing gaseous working fluid in a heat pumping cycle in said heat pumping working volume from a second intermediate temperature confined volume in sequence through a second intermediate temperature thermal exchange means, a thermal regenerative means, and a low temperature thermal exchange means to a low temperature confined volume, and removing heat from said low temperature thermal exchange means; then passing said gaseous working fluid in said heat pumping working volume in reverse from said low temperature confined volume in sequence through said low temperature thermal exchange means, said thermal regenerative means, and said second intermediate temperature thermal exchange means to said second intermediate temperature confined volume, and removing heat from said second intermediate temperature thermal exchange means; and maintaining substantially the same pressure in said first and second intermediate temperature volumes by pressure communication between them.

14. In the process of claim 13, the additional step of operating said driving cycle out of phase with and about 15 to about 35 percent of a cycle ahead of said heat pumping cycle.

15. In the process of claim 13 wherein said first and second intermediate temperature volumes are maintained at substantially the same pressure by free passage of said gaseous working fluid between said first and second intermediate temperature volumes in the vicinity of said intermediate temperature thermal exchange means.

16. In the process of claim 13 wherein said first and second intermediate temperature volumes are maintained at substantially the same pressure by maintaining a substantially gas tight floating piston therebetween and having one of its ends in contact with one of said intermediate temperature volumes and the other end in contact with the other of said intermediate temperature volumes whereby different intermediate temperatures may be maintained in said first and second intermediate temperature volumes.

17. In the process of claim 13 wherein said first and second intermediate temperature volumes are maintained at substantially the same pressure by maintaining a first substantially gas tight floating piston with one end in contact with one of said intermediate temperature volumes and a second substantially gas tight floating piston with one end in contact with the other of said intermediate temperature volumes, the other end of each of said floating pistons in pressure transmission relation with each other.

18. In the process of claim 17 wherein substantially incompressible fluid is maintained between said other ends of said floating pistons.

19. In the process of claim 15 wherein the temperature of said first and second intermediate temperature thermal exchange means is substantially the same.

20. In the process of claim 16 wherein the temperature of said first and second intermediate temperature thermal exchange means is different.

21. In the process of claim 17 wherein the temperature of said first and second intermediate temperature thermal exchange means is different.

* * * * *